US010816274B2

(12) United States Patent
Naito et al.

(10) Patent No.: US 10,816,274 B2
(45) Date of Patent: Oct. 27, 2020

(54) VAPOR CHAMBER

(71) Applicant: Murata Manufacturing Co., Ltd., Nagaokakyo-shi, Kyoto-fu (JP)

(72) Inventors: Akihito Naito, Nagaokakyo (JP); Hiroki Achiwa, Nagaokakyo (JP)

(73) Assignee: MURATA MANUFACTURING CO., LTD., Nagaokakyo-shi, Kyoto-Fu (JP)

( * ) Notice: Subject to any disclaimer, the term of this patent is extended or adjusted under 35 U.S.C. 154(b) by 0 days.

(21) Appl. No.: 16/850,067

(22) Filed: Apr. 16, 2020

(65) Prior Publication Data

US 2020/0292245 A1 Sep. 17, 2020

Related U.S. Application Data

(63) Continuation of application No. PCT/JP2019/046693, filed on Nov. 29, 2019.

(30) Foreign Application Priority Data

Mar. 15, 2019 (JP) ..... 2019-048591

(51) Int. Cl.
*F28D 15/02* (2006.01)
*F28D 15/04* (2006.01)

(52) U.S. Cl.
CPC ..... *F28D 15/0283* (2013.01); *F28D 15/0233* (2013.01); *F28D 15/043* (2013.01)

(58) Field of Classification Search
CPC . F28D 15/043; F28D 15/0233; F28D 15/0283
See application file for complete search history.

(56) References Cited

U.S. PATENT DOCUMENTS

2003/0173064 A1 9/2003 Ueki et al.
2009/0020274 A1* 1/2009 Kawabata ..... F28D 15/0233 165/168
2009/0101308 A1* 4/2009 Hardesty ..... F28D 15/0233 165/80.4
2009/0178784 A1 7/2009 Wang
(Continued)

FOREIGN PATENT DOCUMENTS

DE 102015100301 A1 * 7/2016 ..... F28D 15/0283
JP 2000074582 A * 3/2000 ..... F28D 15/0283
JP 2003254685 A 9/2003
(Continued)

*Primary Examiner* — Devon Russell
(74) *Attorney, Agent, or Firm* — Arent Fox LLP

(57) ABSTRACT

A vapor chamber that includes a housing having a first sheet and a second sheet that oppose each other and of which respective peripheral regions are joined to each other to form a sealing portion. The vapor chamber also includes a working liquid enclosed within the housing and a wick structure on an inside surface of the first sheet or the second sheet. In the vapor chamber, the sealing portion includes a first portion having a first width and a second portion having a second width, the first width being greater than the second width. A specially shaped portion is present in the first portion. The specially shaped portion is a portion at which an inclination angle of the first sheet and/or the second sheet is greater than a second inclination angle of a portion of the first sheet and/or the second sheet outside of the specifically shaped portion.

14 Claims, 7 Drawing Sheets

(56) References Cited

U.S. PATENT DOCUMENTS

| | | | | |
|---|---|---|---|---|
| 2017/0023307 | A1* | 1/2017 | Wang | F28D 15/046 |
| 2017/0138673 | A1 | 5/2017 | Aoki et al. | |

FOREIGN PATENT DOCUMENTS

| | | | | | |
|---|---|---|---|---|---|
| JP | 2016035348 | A | | 3/2016 | |
| JP | 2019020001 | A | * | 2/2019 | |
| JP | 2019020001 | A | | 2/2019 | |
| WO | WO-2018003957 | A1 | * | 1/2018 | F28F 21/081 |
| WO | WO-2018139568 | A1 | * | 8/2018 | H05K 7/20336 |
| WO | WO-2018147283 | A1 | * | 8/2018 | B23K 26/206 |
| WO | WO-2018198354 | A1 | * | 11/2018 | F28D 15/0233 |
| WO | WO-2018198356 | A1 | * | 11/2018 | F28F 13/187 |

* cited by examiner

VAPOR CHAMBER

CROSS REFERENCE TO RELATED APPLICATIONS

The present application is a continuation of International application No. PCT/JP2019/046693, filed Nov. 29, 2019, which claims priority to Japanese Patent Application No. 2019-048591, filed Mar. 15, 2019, the entire contents of each of which are incorporated herein by reference.

FIELD OF THE INVENTION

The present invention relates to a vapor chamber.

BACKGROUND OF THE INVENTION

In recent years, an amount of heat generated by a microelectronics device has tended to increase due to a high degree of integration and a demand for high performance. Meanwhile, a product incorporating such a microelectronics device has become smaller in size, which causes heat generation density to increase. Dissipating heat has become an important issue. This situation is found especially in the field of mobile terminals, such as smartphones and tablet devices, and the thermal design thereof faces increasing difficulties. A graphite sheet or the like has been proposed as a heat dissipating member. However, the heat transport capacity of the graphite sheet is not large enough.

A heat dissipating member having a high heat transport capacity is a vapor chamber, which is a sheet-type heat pipe. The vapor chamber as a whole exhibits an apparent thermal conductivity several times to several tens of times higher than that of a metal, such as copper or aluminum.

As an example of a heat dissipating member using the vapor chamber, Patent Document 1 discloses a tabular heat pipe that includes a container and a working liquid. The container includes a protruding region that is formed of two tabular members opposing each other and is disposed in a central portion of the container. The protruding region has a cavity therein, and the cavity includes a wick structure. The working liquid is enclosed in the cavity. The peripheral portion of the protruding region is sealed by laser welding.

Patent Document 1: Japanese Unexamined Patent Application Publication No. 2016-35348

SUMMARY OF THE INVENTION

In the tabular heat pipe (hereinafter referred to as a "vapor chamber") described in Patent Document 1, the peripheral portion of the container is welded by a laser beam, thereby forming a laser welded portion.

Patent Document 1 describes the welding width of the laser welded portion. However, the shape of the laser welded portion is not described specifically. Accordingly, the laser welded portion that seals the peripheral portion of the container is assumed to have a constant width.

In the vapor chamber, water is normally injected into the housing and serves as a working liquid. If the ambient temperature in a service environment exceeds 100° C., the pressure inside the housing exceeds one atmospheric pressure, and the housing may swell like a balloon. The internal pressure of the housing may cause part of the sealed portion at the peripheral portion of the housing to break. As a result, the vapor-phase working liquid is released from the broken portion, which causes the vapor chamber to stop functioning.

One way to deal with such a problem is to increase the durability of the housing against swelling by widening the sealing portion. However, widening the sealing portion causes the effective working region of the vapor chamber to decrease.

It then becomes necessary to increase the entire size of the vapor chamber to obtain a sufficient amount of the effective working region.

However, it is difficult in reality to increase the size of the vapor chamber for devices, such as mobile terminals, of which size reduction is demanded.

The present invention is made in such circumstances, and an object of the present invention is to provide a vapor chamber having a structure that has a high durability against swelling of the housing and that can prevent leakage of the working liquid.

A vapor chamber according to the present invention includes a housing formed of a first sheet and a second sheet that oppose each other and of which respective peripheral regions are joined to each other to form a sealing portion. The vapor chamber also includes a working liquid enclosed within the housing and a wick structure on an inside surface of the first sheet or the second sheet. In the vapor chamber, the sealing portion includes a first portion having a first width and a second portion having a second width, the first width being greater than the second width. A specially shaped portion is present in the first portion. The specially shaped portion has a first inclination angle of the first sheet and/or the second sheet that rises from the first portion in a first housing-side region of the specially shaped portion that is greater than a second inclination angle of the first sheet and/or the second sheet in a second housing-side region outside of the specifically shaped portion.

According to the present invention, a vapor chamber having a structure that has a high durability against swelling of the housing and that can prevent leakage of the working liquid can be provided.

DETAILED DESCRIPTION OF THE PREFERRED EMBODIMENTS

A vapor chamber according to the present invention will be described below.

The present invention, however, is not limited to the configurations described herein. The present invention can be applied in appropriately modified forms insofar as the modified forms stay within the spirit of the present invention. Note that two or more of desirable configurations of the present invention described herein may be combined together, and such a combination is deemed within the scope of the present invention.

It should be understood that embodiments described herein are merely examples and configurations described in different embodiments can be partially combined, or replaced, with each other.

A vapor chamber according to the present invention includes a housing formed of a first sheet and a second sheet that oppose each other and of which respective peripheral regions are joined to each other to form a sealing portion. The vapor chamber also includes a working liquid enclosed within the housing and a wick structure on an inside surface of the first sheet or the second sheet. In the vapor chamber, the sealing portion includes a first portion having a first width and a second portion having a second width, the first width being greater than the second width. A specially shaped portion is present in the first portion. The specially shaped portion has a first inclination angle of the first sheet and/or the second sheet that rises from the first portion in a first housing-side region of the specially shaped portion that is greater than a second inclination angle of the first sheet and/or the second sheet in a second housing-side region outside of the specifically shaped portion.

Figure 1:
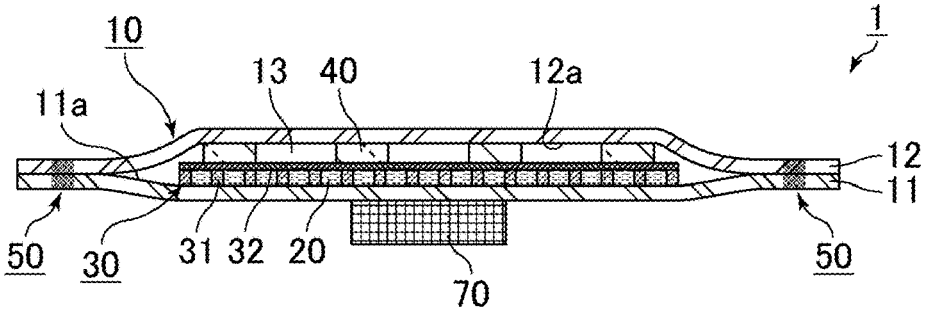
FIG. 1 is a cross-sectional view schematically illustrating an example of a vapor chamber.

FIG. 1 is a cross-sectional view schematically illustrating an example of structure of the vapor chamber.

FIG. 1 is a cross section of the vapor chamber that is cut at a position at which neither a wide sealing portion nor a specially shaped portion is disposed. The wide sealing portion and the specially shaped portion will be described later.

A vapor chamber 1 illustrated in FIG. 1 includes a housing 10, a working liquid 20, a wick structure 30, and multiple pillars 40. The housing 10 is formed of a first sheet 11 and a second sheet 12 that oppose each other. The working liquid 20 is enclosed inside the housing 10. The wick structure 30 is disposed on a principal surface 11*a* of the first sheet 11 that opposes the second sheet 12 (i.e., an inside surface 11*a* of the first sheet 11). The pillars 40 are disposed on a principal surface 12*a* of the second sheet 12 that opposes the first sheet 11 (i.e., an inside surface 12*a* of the second sheet 12). The housing 10 has a cavity 13 therein, and the pillars 40 supports the first sheet 11 and the second sheet 12 so as to maintain the cavity 13.

The first sheet 11 and the second sheet 12 are joined to and sealed to each other along peripheral portions thereof. In the vapor chamber 1 illustrated in FIG. 1, the wick structure 30 includes multiple protruding portions 31 that are disposed at predetermined intervals on the inside surface 11*a* of the first sheet 11 and also includes a mesh 32 that is disposed on the protruding portions 31.

The protruding portions 31 may be formed integrally with the first sheet 11. For example, the protruding portions 31 may be formed by etching the inside surface 11*a* of the first sheet 11. Similarly, the pillars 40 may be integrally formed with the second sheet 12. For example, the pillars 40 may be formed by etching the inside surface 12*a* of the second sheet 12.

A portion at which respective peripheral portions of the first sheet 11 and the second sheet 12 are joined to each other is a sealing portion 50.

The shape of the sealing portion 50 will be described later.

The working liquid 20 is present in the wick structure 30 as a liquid phase. The working liquid 20 is also present within the cavity 13 as a vapor phase (water vapor in the case of the working liquid 20 being water).

A heat generating member 70 is disposed on the principal surface of the first sheet 11 that does not oppose the second sheet 12 (i.e., the outside surface).

The working liquid 20 present in the wick structure 30 is evaporated at a position directly above the heat generating member 70 due to its heat, which transfers heat from the heat generating member 70. The evaporated working liquid 20 moves from the mesh 32 to the cavity 13.

The evaporated working liquid 20 moves within the housing 10 and is condensed to the liquid phase near the peripheral portion of the housing 10.

The working liquid 20 that has been returned to the liquid phase is absorbed by the wick structure 30 and is moved within the wick structure 30 toward the heat generating member 70 due to the capillary force of the wick structure 30. The heat from the heat generating member 70 is dissipated in this manner.

The heat generating member is thus cooled by the vapor chamber due to the working liquid being circulated within the housing as described above.

Figure 2:
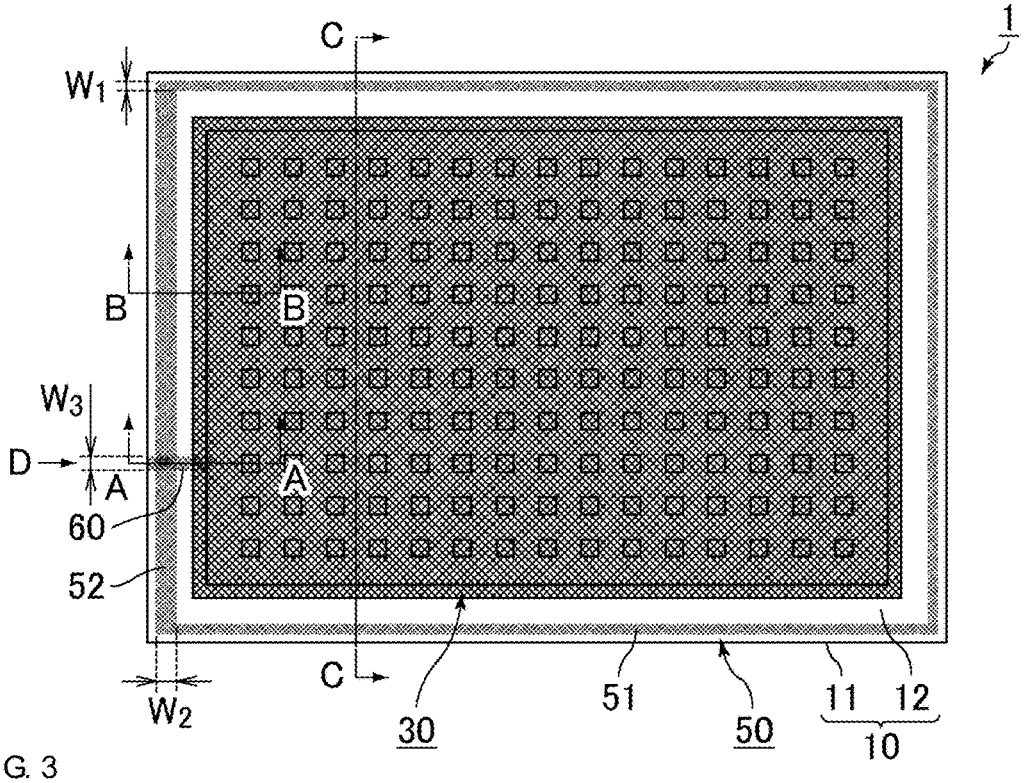
FIG. 2 is a top view schematically illustrating an example of a vapor chamber.

FIG. 2 is a top view schematically illustrating an example of the vapor chamber.

FIG. 2 is the top view in which the second sheet 12 of the vapor chamber 1 is viewed from above. In order to indicate the position of the wick structure 30, FIG. 2 shows the wick structure 30 as if the second sheet 12 was transparent.

Note that FIG. 1 is a cross section of the vapor chamber that is cut along line C-C in FIG. 2.

Positions of the sealing portion and the wide sealing portion will be described with reference to FIG. 2.

The first sheet 11 and the second sheet 12 are sealed with each other by the sealing portion 50 along peripheral portions thereof.

In the vapor chamber illustrated in FIG. 2, the housing is shaped like a rectangle as viewed from above, and the sealing portion 50 is shaped so as to follow the periphery of the rectangle.

A wide sealing portion 52 is formed along one short side of the four sides of the sealing portion 50. The wide sealing portion 52 has a larger width, whereas other sealing portions disposed along other three sides (otherwise referred to as a "normal sealing portion 51") have a smaller width compared with the wide sealing portion 52.

In the case of the first sheet 11 and the second sheet 12 being made of a metal, the sealing portion 50 is preferably formed by welding.

The method of joining the first sheet and the second sheet together at the sealing portion is not limited to welding but may be soldering or diffusion bonding.

Since the width at the wide sealing portion 52 is wider than that of the normal sealing portion 51, the durability of the wide sealing portion 52 is expected to be high when the housing swells.

In the vapor chamber according to the present invention, a specially shaped portion 60 is formed in the wide sealing portion 52, and when the housing swells, a greater stress is thereby applied to the specially shaped portion 60.

FIG. 2 indicates a position at which a specially shaped portion 60 is disposed in the wide sealing portion 52.

Since the wide sealing portion 52 has a high durability when the housing 10 swells, the specially shaped portion 60 receives the stress when the housing 10 swells. This can prevent the sealing portion 50 from breaking when the housing 10 swells.

Since the wide sealing portion is formed in part of the peripheral portion of the housing, the vapor chamber is provided with a larger effective working area compared with a case in which the wide sealing portion is formed in the entire peripheral portion of the housing.

The specially shaped portion 60 of FIG. 2 is formed at one position in the wide sealing portion 52 so as to straddle the wide sealing portion 52. The specially shaped portion 60 is formed so as to extend in a direction orthogonally intersecting the wide sealing portion 52. Note that the position of the specially shaped portion 60 and the number the specially shaped portions 60 are not limited to what is illustrated in FIG. 2.

The specially shaped portion is a portion at which an inclination angle of the first sheet and/or the second sheet is greater than a second inclination angle of a portion of the first sheet and/or the second sheet outside of the specifically shaped portion. The inclination angle is an angle at which the first sheet and/or the second sheet rises from the sealing portion within a housing-side region of the specially shaped portion.

Figure 3:
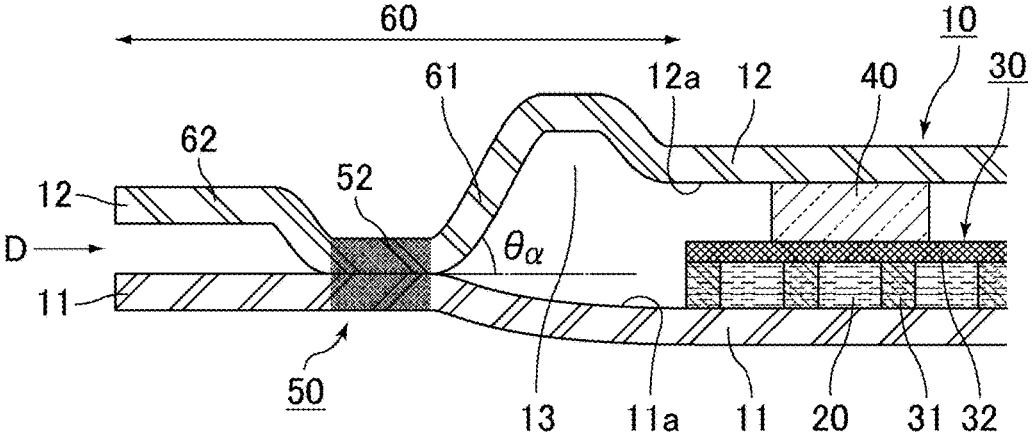
FIG. 3 is a cross-sectional view schematically illustrating an example of cross section of the vapor chamber that is cut at a position at which a specially shaped portion is present.
Figure 4:
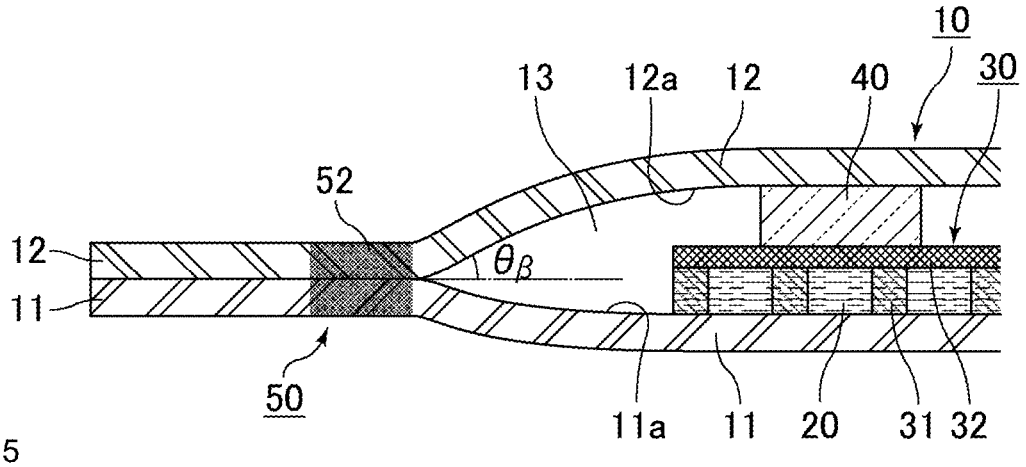
FIG. 4 is a cross-sectional view schematically illustrating an example of cross section of the vapor chamber that is cut at a position at which the specially shaped portion is not present.

The following further describes this point with reference to FIGS. 3 and 4.

FIG. 3 is a cross-sectional view schematically illustrating an example of cross section of the vapor chamber that is cut at a position at which the specially shaped portion is present. FIG. 3 corresponds to a cross section cut along line A-A in FIG. 2.

FIG. 4 is a cross-sectional view schematically illustrating an example of cross section of the vapor chamber that is cut at a position at which the specially shaped portion is not present. FIG. 4 corresponds to a cross section cut along line B-B in FIG. 2.

In FIG. 3, the position of the specially shaped portion 60 is indicated by the two-directional arrow. A housing-side region 61 is a region of the specially shaped portion 60 that is located closer to the center of the housing 10 with respect to the sealing portion 50. A non-housing-side region 62 is a region of the specially shaped portion 60 that is located outside the sealing portion 50 (opposite to the center of the housing 10 with respect to the sealing portion 50).

The first sheet 11 and the second sheet 12 are joined to each other at the sealing portion 50, and there is no space provided between the first sheet 11 and the second sheet 12 at the sealing portion 50. However, in the housing-side region 61 of the specially shaped portion 60, there is a space (cavity 13) created between the first sheet 11 and the second sheet 12.

As illustrated in FIG. 3, in the housing-side region 61 of the specially shaped portion 60, the second sheet 12 rises with respect to the border line between the second sheet 12 and the first sheet 11 at the sealing portion 50 (which is indicated by the dash-dot line in FIG. 3). The angle between the raised second sheet 12 and the border line is referred to as the inclination angle of the second sheet that rises from the sealing portion 50.

This inclination angle is denoted by $\theta\alpha$ in FIG. 3.

As illustrated in FIG. 3, the second sheet 12 rises greatly from the sealing portion 50 and subsequently descends slightly so that the thickness of the space (cavity 13) between the first sheet 11 and the second sheet 12 is made constant.

As illustrated in FIG. 4, the inclination angle of the second sheet rising from the sealing portion is $\theta\beta$ at a position at which the specially shaped portion is not present, in which $\theta\beta$ is defined similarly to $\theta\alpha$ of FIG. 3.

In the case of $\theta\alpha>\theta\beta$ when comparing $\theta\alpha$ of FIG. 3 to $\theta\beta$ of FIG. 4, the specially shaped portion is regarded as a portion having a greater inclination angle of the second sheet that rises from the sealing portion in the housing-side region.

The specially shaped portion has been described with reference to FIGS. 3 and 4 by comparing inclination angles of the second sheet that rises from the sealing portion. Alternatively, the specially shaped portion may be defined as a portion having a greater inclination angle of the first sheet that rises from the sealing portion in the housing-side region by comparing inclination angles of the first sheet rising from the sealing portion.

Alternatively, the specially shaped portion may be defined as a portion having a greater inclination angle of either the first sheet or the second sheet that rises from the sealing portion by comparing the inclination angle to an inclination angle at another location.

Alternatively, in the specially shaped portion, the inclination angle of the second sheet rising from the sealing portion may be greater than that at another location, and at the same time, the inclination angle of the first sheet rising from the sealing portion may be greater than that at another location.

Thus, the specially shaped portion is the portion having the greater inclination angle of the first sheet and/or the second sheet that rises from the sealing portion in the housing-side region. Accordingly, the specially shaped portion has a larger volume compared with other portions at which the first sheet and/or the second sheet rises from the sealing portion. The specially shaped portion is a portion in which vapor tends to accumulate. The specially shaped portion is a portion to which a greater stress is applied when the housing swells. In other words, the specially shaped portion is formed intentionally into such a shape, which causes a greater stress to be applied thereto when the housing swells. The specially shaped portion is formed in the wide sealing portion that exhibits a high durability when the housing swells. Accordingly, even if a greater stress is applied to the specially shaped portion, the sealing portion is prevented from breaking.

The inclination angle of the first sheet and/or the second sheet rising from the sealing portion may be measured by filling a target portion with a resin and observing the target portion.

More specifically, the vapor chamber is cut at a position so as to include a region in which the first sheet and/or the second sheet rises from the sealing portion but cut at a position slightly deviating from the target portion to be observed. The target portion is filled with a resin, such as epoxy resin, and subsequently the target portion is polished to expose the portion to be observed with a microscope.

By using this method, the inclination angle of the first sheet and/or the second sheet rising from the sealing portion can be measured while the influence of springback caused by cutting is reduced.

In the case in which the specially shaped portion is defined by comparing inclination angles of the second sheet rising from the sealing portion, the inclination angle of the second sheet at a position where the specially shaped portion is not present may be 0°.

Figure 5:
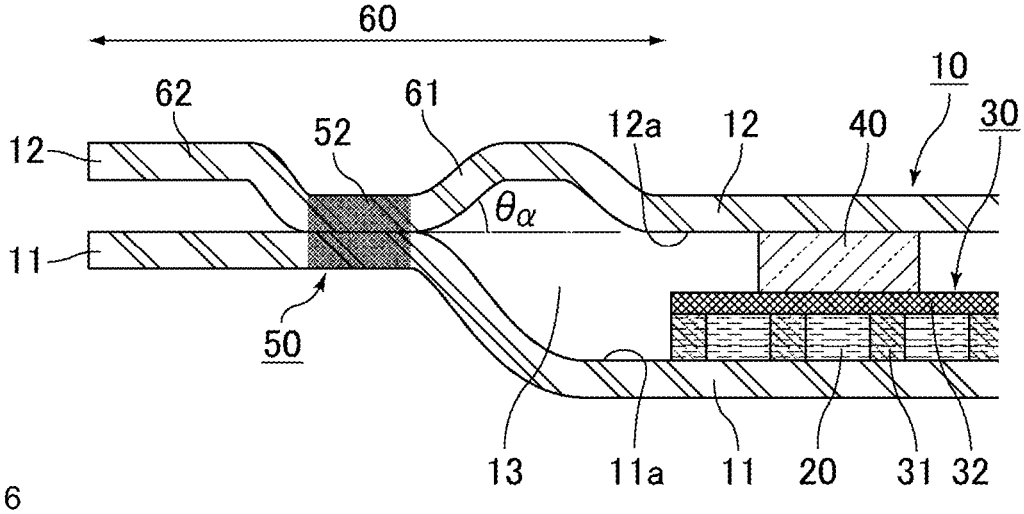
FIG. 5 is a cross-sectional view schematically illustrating another example of cross section of the vapor chamber that is cut at a position at which a specially shaped portion is present.

FIG. 5 is a cross-sectional view schematically illustrating another example of cross section of the vapor chamber that is cut at a position at which the specially shaped portion is present.

Figure 6:
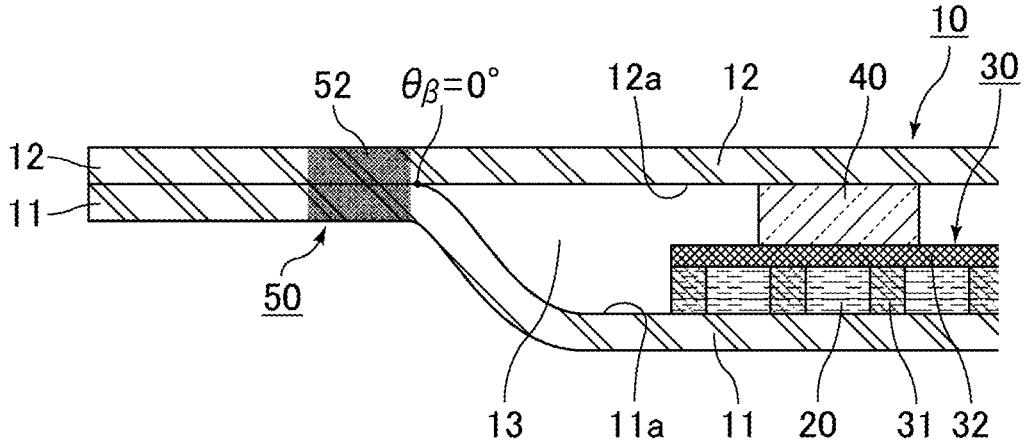
FIG. 6 is a cross-sectional view schematically illustrating another example of cross section of the vapor chamber that is cut at a position at which the specially shaped portion is not present.

FIG. 6 is a cross-sectional view schematically illustrating another example of cross section of the vapor chamber that is cut at a position at which the specially shaped portion is not present.

In FIG. 5, the inclination angle of the second sheet 12 rising from the sealing portion 50 in the specially shaped portion 60, which is denoted by θα, is relatively gτeat.

On the other hand, as illustrated in FIG. 6, the inclination angle θβ of the second sheet 12 rising from the sealing portion 50 is 0° at a position where the specially shaped portion is not present, in which θβ is defined similarly to θα of FIG. 5.

In this case, θα>θβ also holds, and accordingly this case is included in the vapor chamber of the present invention.

As a method of forming the specially shaped portion shaped as illustrated in FIGS. 2 and 3, a sheet is formed so as to have a different cross section compared with other portions of the sheet at a position where the specially shaped portion is to be formed before forming the sealing portion.

Figure 7:
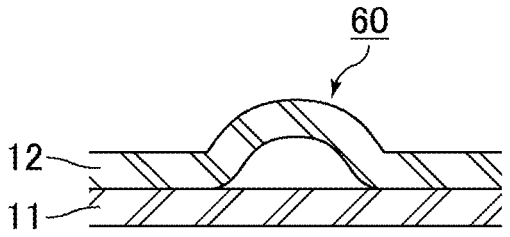
FIG. 7 is a side view schematically illustrating a shape example of a specially shaped portion when a peripheral portion of the vapor chamber is viewed from outside.

FIG. 7 is a side view schematically illustrating a shape example of the specially shaped portion when a peripheral portion of the vapor chamber is viewed from the outside of the vapor chamber. FIG. 7 corresponds to a side view of FIGS. 2 and 3 as viewed in the direction of arrow D.

FIG. 7 illustrates a portion having a cross section of a semicylinder. This portion is formed by raising part of the second sheet 12 from the joint surface between the first sheet 11 and the second sheet 12.

The portion having the cross section of the semicylinder becomes the specially shaped portion 60.

In manufacturing the vapor chamber, the first sheet 11 and the second sheet 12 are overlaid on each other, and the sealing portion 50 is formed at the final step. Before the sealing portion 50 is formed, the portion having the cross section of the semicylinder is provided between the first sheet 11 and the second sheet 12. The sealing portion 50 is formed in the peripheral portion of the vapor chamber at a position as illustrated in FIG. 2 or FIG. 3. Although the first sheet 11 and the second sheet 12 are joined at the sealing portion 50, there remains the shape of the semicylindrical portion that has been formed by raising the second sheet 12 in the housing-side region of the sealing portion 50 prior to forming the sealing portion 50. Accordingly, the semicylindrical portion becomes the portion having a greater inclination angle of the second sheet 12 that rises from the sealing portion 50.

In other words, the portion having the cross section of the semicylinder prior to forming the sealing portion becomes the specially shaped portion after forming the sealing portion.

The cross-sectional shape at the position at which the specially shaped portion is formed is not limited to that of the semicylinder. However, it is preferable that the portion be shaped like a cylinder that reaches the inside of the housing. Accordingly, this portion can be utilized as an injection/drainage channel for pouring the working liquid into the housing or as a channel for depressurizing the inside of the housing.

In the vapor chamber according to the present invention, the width of the wide sealing portion (the width indicated by the two-directional arrow $W_2$ in FIG. 2) is not specifically limited but is preferably 0.5 mm to 3 mm.

In addition, the width of the normal sealing portion, which is the sealing portion other than the wide sealing portion (the width indicated by the two-directional arrow $W_1$ in FIG. 2), is not specifically limited but is preferably 0.1 mm to 1 mm.

The ratio of width of the wide sealing portion to the width of the normal sealing portion (i.e., the width of the wide sealing portion/the width of the normal sealing portion) is preferably 1.5 to 5.

The width of the specially shaped portion (the width indicated by the two-directional arrow $W_3$ in FIG. 2) is not specifically limited but is preferably 0.5 mm to 3 mm.

In the vapor chamber according to the present invention, the wick structure need not have the protruding portions.

Figure 8:
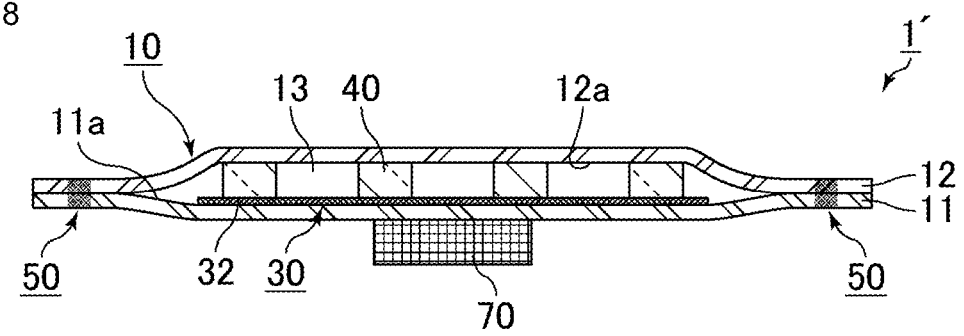
FIG. 8 is a cross-sectional view schematically illustrating another example of structure of the vapor chamber.

FIG. 8 is a cross-sectional view schematically illustrating another example of structure of the vapor chamber.

As illustrated in FIG. 8, the vapor chamber 1' does not include the protruding portions 31 of the vapor chamber 1 illustrated in FIG. 1, and the housing 10 includes the mesh 32 and the pillars 40 that are disposed in the cavity 13 formed inside the housing 10. The mesh 32 serves as the wick structure 30. The working liquid (not illustrated) is present in the cavity 13 of the housing 10.

Such a structure can also function as the vapor chamber.

In the vapor chamber 1' illustrated in FIG. 8, the sealing portion, the wide sealing portion, and the specially shaped portion can be shaped similarly to those of the vapor chamber 1 illustrated in FIG. 1.

The following describes other shape examples of the housing as viewed from above and other examples of positions at which the wide sealing portion and the specially shaped portion are formed according to the vapor chamber of the present invention.

The vapor chamber of the present invention may have the following configurations, which can also provide advantageous effects.

Figure 9A:
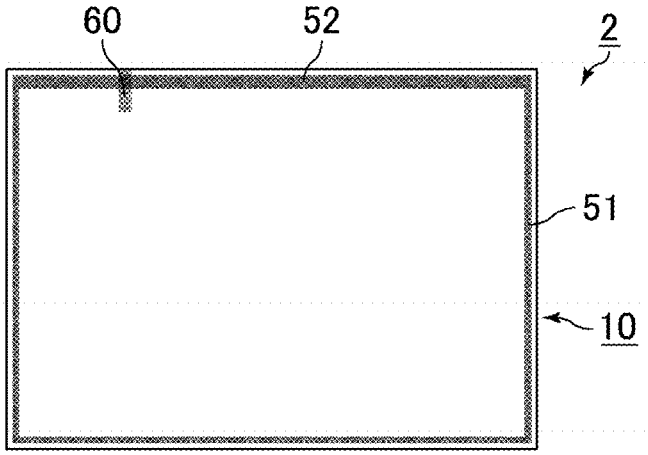
FIG. 9(*a*), FIG. 9(*b*), and FIG. 9(*c*) are top views schematically illustrating examples in which as viewed from above, a housing of the vapor chamber is formed into different shapes and a wide sealing portion and the specially shaped portion are formed at different positions.
Figure 9B:
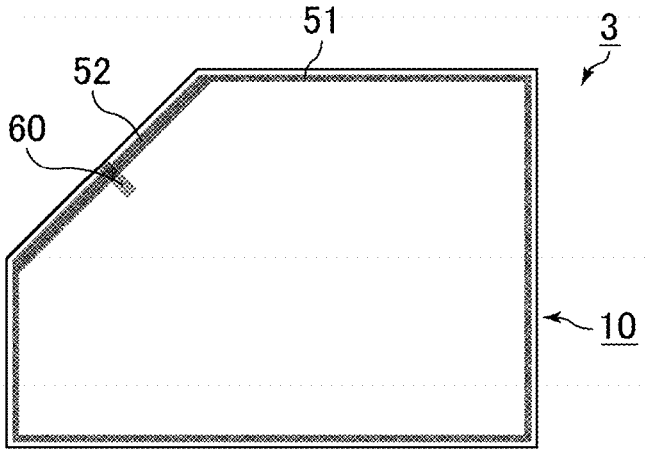
Figure 9C:
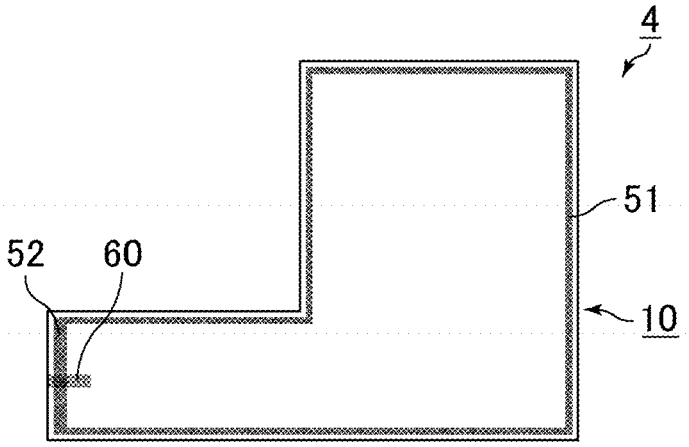

FIGS. 9(*a*), 9(*b*), and 9(*c*) are tθβ views schematically illustrating examples in which the housing of the vapor chamber is formed into different shapes as viewed from above, and the wide sealing portion and the specially shaped portion are formed at different positions.

The vapor chambers illustrated in FIGS. 9(*a*), 9(*b*), and 9(*c*) have respective housings that are shaped like polygons as viewed from above. The wide sealing portion is formed along one side of each polygon.

A vapor chamber 2 illustrated in FIG. 9(*a*) has a housing shaped like a rectangle as viewed from above, and the wide sealing portion 52 and the specially shaped portion 60 are formed at a long side of the rectangle.

A vapor chamber 3 illustrated in FIG. 9(*b*) has a housing shaped like a pentagon as viewed from above, which is formed by chamfering one corner of the rectangle. The wide sealing portion 52 and the specially shaped portion 60 are formed at the chamfered side of the pentagon.

A vapor chamber 4 illustrated in FIG. 9(*c*) has a housing shaped like a hexagon as viewed from above, which is formed by cutting out a small rectangle from a rectangle. The wide sealing portion 52 and the specially shaped portion 60 are formed at the shortest side of the hexagon.

Figure 10:
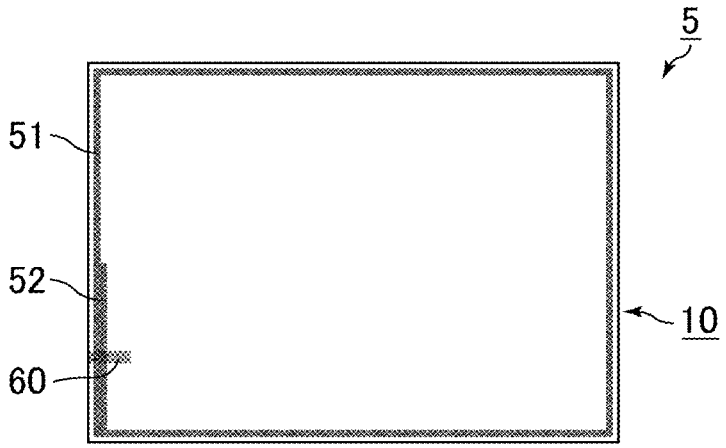
FIG. 10 is a top view schematically illustrating another example in which the wide sealing portion and the specially shaped portion are formed at different positions in the vapor chamber.

FIG. 10 is a top view schematically illustrating another example in which the wide sealing portion and the specially shaped portion are formed at different positions in the vapor chamber.

A vapor chamber illustrated in FIG. 10 has a housing shaped like a polygon as viewed from above, and the wide sealing portion is formed along part of one side of the polygon.

A vapor chamber 5 illustrated in FIG. 10 has a housing shaped like a rectangle as viewed from above, and the wide sealing portion 52 and the specially shaped portion 60 are formed at part of a short side of the rectangle.

The normal sealing portion 51 is formed in the other part of the short side, other than the part along which the wide sealing portion 52 is formed.

Figure 11A:
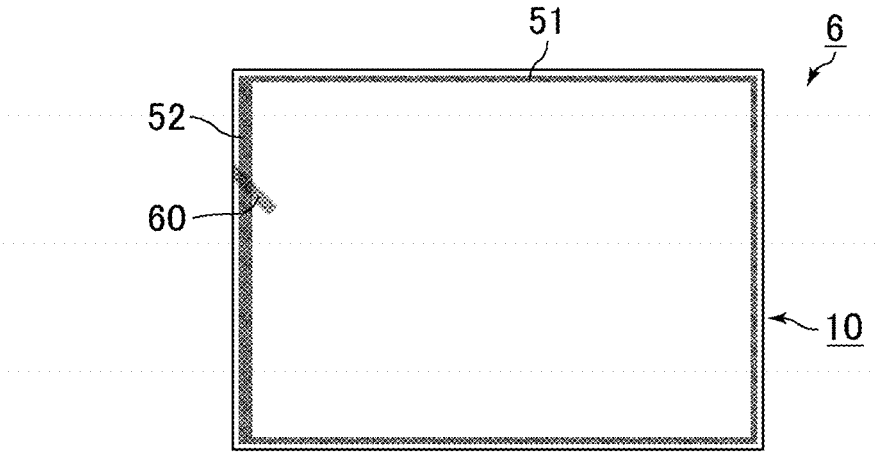
FIG. 11(*a*), FIG. 11(*b*), and FIG. 11(*c*) are top views schematically illustrating other examples in which the specially shaped portion is formed at different positions in the vapor chamber.
Figure 11B:
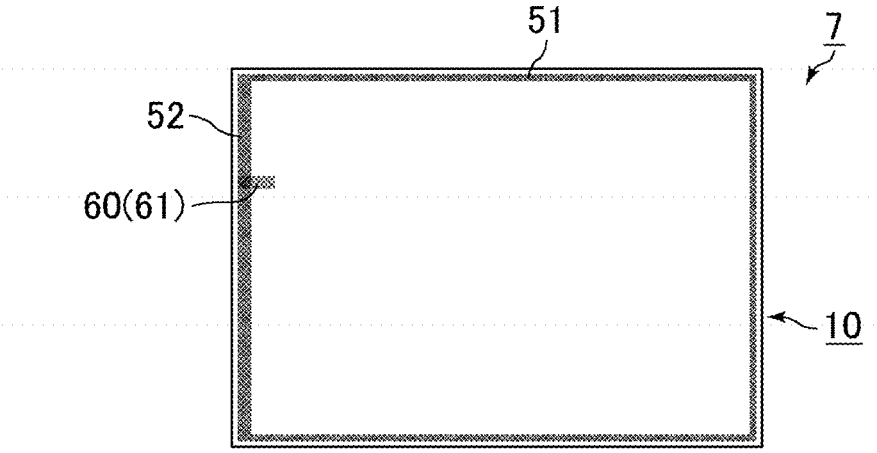
Figure 11C:
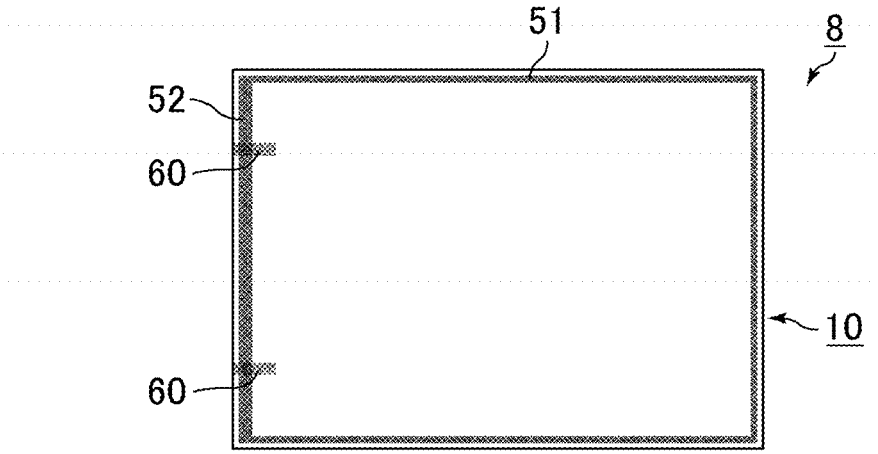

FIGS. 11(*a*), 11(*b*), and 11(*c*) are tθβ views schematically illustrating other examples in which the specially shaped portion is formed at different positions in the vapor chamber.

Vapor chambers illustrated in FIGS. 11(*a*), 11(*b*), and 11(*c*) have a housing shaped like a polygon as viewed from above, and the wide sealing portion is formed along one side of the polygon.

A vapor chamber 6 illustrated in FIG. 11(*a*) has a housing shaped like a rectangle as viewed from above, and the wide sealing portion 52 and the specially shaped portion 60 are formed at a short side of the rectangle.

The specially shaped portion 60 is formed so as to extend obliquely with respect to the wide sealing portion 52.

A vapor chamber 7 illustrated in FIG. 11(*b*) has a housing shaped like a rectangle as viewed from above, and the wide sealing portion 52 and the specially shaped portion 60 are formed at a short side of the rectangle.

The specially shaped portion 60 is formed only in the housing-side region and does not straddle the wide sealing portion 52.

Put another way by using a cross section of the specially shaped portion 60, the specially shaped portion 60 includes the housing-side region 61 as illustrated in FIG. 3 but does not include the non-housing-side region 62, and can have the first sheet 11 and the second sheet 12 in contact with each other as illustrated in FIG. 4.

A vapor chamber 8 illustrated in FIG. 11(*c*) has a housing shaped like a rectangle as viewed from above. The wide sealing portion 52 is formed along a short side of the rectangle, and the specially shaped portion 60 is formed at two locations along the short side of the rectangle.

Providing multiple specially shaped portions enables the specially shaped portions to receive stresses collectively when the housing swells.

Figure 12:
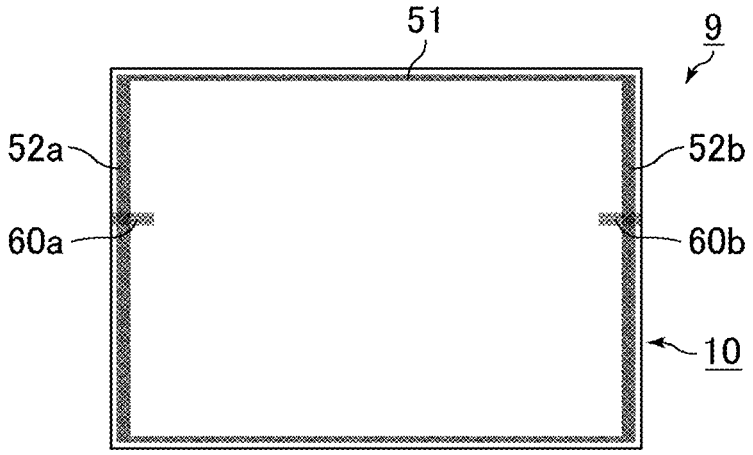
FIG. 12 is a top view schematically illustrating another example in which the specially shaped portion is formed at different positions in the vapor chamber.

FIG. 12 is a top view schematically illustrating another example in which the specially shaped portion is formed at different positions in the vapor chamber.

A vapor chamber 9 illustrated in FIG. 12 has a housing shaped like a rectangle as viewed from above, and the wide sealing portions (wide sealing portions 52*a* and 52*b*) are formed along two short sides of the rectangle, respectively. In addition, specially shaped portions 60*a* and 60*b* are formed in the wide sealing portions 52*a* and 52*b*, respectively.

Providing multiple wide sealing portions and multiple specially shaped portions enables the specially shaped portions to receive stresses collectively when the housing swells.

However, the longer the wide sealing portion formed in the peripheral portion of the housing, the smaller the effective working area of the vapor chamber. Accordingly, it is better to make the wide sealing portion shorter.

Figure 13A:
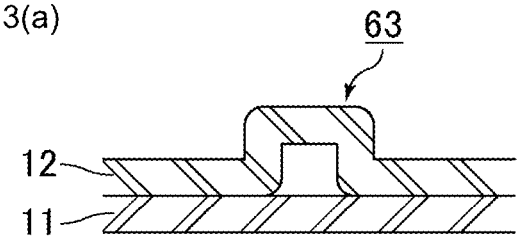
FIG. 13(*a*), FIG. 13(*b*), and FIG. 13(*c*) are side views schematically illustrating other examples in which the specially shaped portion is formed into different shapes as a peripheral portion of the vapor chamber is viewed from outside.
Figure 13B:
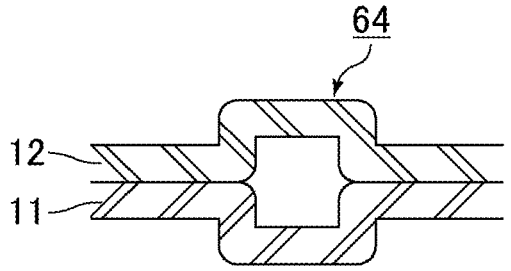
Figure 13C:
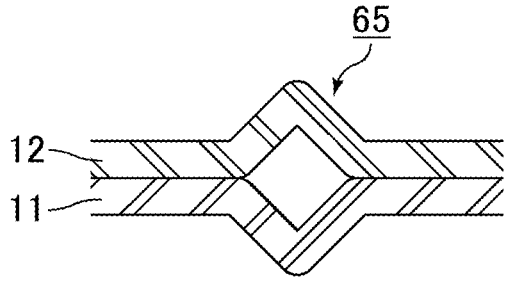

FIGS. 13(*a*), 13(*b*), and 13(*c*) are side views schematically illustrating other examples in which the specially shaped portion is formed into different shapes as the peripheral portion of the vapor chamber is viewed from outside.

These figures illustrate modification examples of the shapes of the specially shaped portion that has been described with reference to the side view of FIG. 7.

A specially shaped portion 63 illustrated in FIG. 13(*a*) is shaped like a rectangular cylinder having a rectangular cross section. The rectangular cylinder is formed such that a portion of the second sheet 12 is raised from the contact surface of the first sheet 11 and the second sheet 12 so as to form the rectangular cross section.

In this case, the inclination angle of the second sheet that rises from the sealing portion becomes great in the housing-side region.

A specially shaped portion 64 illustrated in FIG. 13(*b*) is shaped like a rectangular cylinder having a rectangular cross section. The rectangular cylinder is formed such that a portion of the second sheet 12 and a portion of the first sheet 11 are raised from the contact surface of the first sheet 11 and the second sheet 12 so as to form the rectangular cross section.

In this case, the inclination angles of both second sheet and first sheet that rise from the sealing portion become great in the housing-side region.

A specially shaped portion 65 illustrated in FIG. 13(*c*) is shaped like a rectangular cylinder having a rectangular cross section. The rectangular cylinder is formed such that a portion of the second sheet 12 and a portion of the first sheet 11 are raised from the contact surface of the first sheet 11 and the second sheet 12 so as to each form a triangular cross section.

In this case, the inclination angles of both second sheet and first sheet that rise from the sealing portion become great in the housing-side region.

The vapor chamber according to the present invention can provide similar advantageous effects with any one of the above-described shapes that the specially shaped portion assumes.

In the case in which the cross-sectional shape of the cylinder that reaches the inside of the housing is formed at the position at which the specially shaped portion is to be formed, this portion can be utilized as an injection/drainage channel for pouring the working liquid into the housing.

The shape of the housing is not specifically limited in the vapor chamber of the present invention.

For example, the shape of the housing as viewed from above may be a polygon, such as a triangle or a rectangle, a circle, an oval, or a combination thereof.

In the vapor chamber of the present invention, the first sheet and the second sheet that constitute the housing may be overlaid with respective ends being aligned with each other or slightly deviating from each other.

In the vapor chamber of the present invention, the materials of the first sheet and the second sheet are not specifically limited insofar as they have characteristics appropriate for the vapor chamber in terms of thermal conductivity, strength, and flexibility, for example. The materials of the first sheet and the second sheet may be preferably a metallic material, for example, copper, nickel, aluminum, magnesium, titan, iron, or an alloy containing such metals as main ingredients. The materials of the first sheet and the second sheet may be more preferably copper.

In the vapor chamber of the present invention, the materials of the first sheet and the second sheets may be different from each other. For example, a material having a high strength may be used for the first sheet, which can thereby disperse stresses applied to the housing. Using different materials can provide one sheet with one function and the other sheet with an additional function. These functions are not specifically limited here, but may be, for example, a function of thermal conductivity or a function of a shield against electromagnetic waves.

In the vapor chamber of the present invention, the thicknesses of the first sheet and the second sheet are not specifically limited. However, in the case of the first sheet and the second sheet being too thin, the strength of the housing decreases, which leads to vulnerability to deformation. Accordingly, respective thicknesses of the first and the second sheets are preferably 20 μm or more, and more preferably 30 μm or more. On the other hand, in the case of the first sheet and the second sheet being too thick, it becomes difficult to reduce the entire thickness of the vapor chamber. Accordingly, respective thicknesses of the first and the second sheets are preferably 200 μm or less, more preferably 150 μm or less, and even more preferably 100 μm or less. The first sheet and the second sheet may have the same thickness or may have different thicknesses.

Note that in the case of the first sheet being integrally formed with the protruding portions that constitute the wick structure, the thickness of the first sheet is measured at a position not in contact with the protruding portions. In the case of the second sheet being integrally formed with the pillars, the thickness of the second sheet is measured at a position not in contact with the pillars.

In the vapor chamber of the present invention, the first sheet may have a constant thickness or may have a thick portion and a thin portion. Similarly, the second sheet may have a constant thickness or may have a thick portion and a thin portion. The portion of the second sheet that is not in contact with the pillars may be recessed into the housing.

In the vapor chamber of the present invention, the working liquid is not specifically limited insofar as the working liquid is subjected to vapor-liquid phase change in the environment inside the housing. The working liquid may be, for example, water, an alcohol, or an alternative fluorocarbon. The working liquid is preferably an aqueous compound, and more preferably water.

In the vapor chamber of the present invention, the wick structure is not specifically limited insofar as the wick structure has a capillary structure that enables the working liquid to move by capillary forces. The capillary structure of the wick structure may be a known structure used in a known vapor chamber. For example, the capillary structure may encompass micro structures having irregularities, such as pores, grooves, or protrusions. In other words, the capillary structure may encompass a porous structure, a fibrous structure, a pleated structure, or a reticular structure.

In the vapor chamber of the present invention, the wick structure is preferably disposed continuously from the evaporation section to the condensation section inside the housing. At least part of the wick structure may be integrally formed with the housing.

In the vapor chamber of the present invention, the wick structure may include a mesh, a nonwoven fabric, or a porous member disposed on the surface of the wick structure that does not oppose the inside surface of the first sheet. For example, the wick structure may be formed of multiple protruding portions disposed at predetermined intervals on the inside surface of the first sheet and also formed of the mesh, the nonwoven fabric, or the porous member disposed on the protruding portions. Alternatively, the wick structure may be formed of the mesh, the nonwoven fabric, or the porous member disposed directly on the inside surface of the first sheet.

In the vapor chamber of the present invention, in the case of the wick structure including multiple protruding portions disposed on the inside surface of the first sheet, the working liquid can be retained among the protruding portions, which improves the heat transport capacity of the vapor chamber.

In the present description, a "protruding portion" refers to a high portion relative to the surrounding area. Each protruding portion may be formed as a portion protruding from the inside surface or may be formed as a relatively high portion formed by a recess, such as a groove, in the inside surface.

The shape of each protruding portion is not specifically limited but may be formed, for example, as a circular column, a rectangular column, a truncated cone, or a truncated pyramid. The shape of the protruding portion may be like a wall, in other words, may be such that a groove is formed between adjacent protruding portions.

In the vapor chamber of the present invention, the pillars support the first sheet and the second sheet from inside. Disposing the pillars inside the housing can suppress deformation of the housing in such a case that, for example, the inside of the housing is depressurized or an external pressure is applied to the housing. Note that the pillars may be in contact with the first sheet and the second sheet and support them directly. Alternatively, the pillars may support them with other members, such as the wick structure, interposed therebetween.

The shape of each pillar is not specifically limited but may be formed, for example, into a circular column, a rectangular column, a truncated cone, or a truncated pyramid.

The pattern of arranging the pillars is not specifically limited but may preferably be an equidistant arrangement, such as a grid-like pattern in which the pillars are disposed at equidistant grid points. The equidistant arrangement of the pillars provides the entire vapor chamber with a uniform strength.

The vapor chamber of the present invention is not limited to the embodiments described above but may be subjected to various alterations and modifications in the configurations, manufacturing conditions, or the like, of the vapor chamber within the scope of the present invention.

For example, the vapor chamber of the present invention may include the wick structure disposed on the inside surface of the second sheet. In this case, the pillars, which are not directly in contact with the second sheet, support the second sheet with the wick structure being interposed therebetween.

The vapor chamber according to the present invention has the high heat transport and thermal diffusion capacities as described above. Accordingly, the vapor chamber can be preferably applied as a heat dissipation device.

In addition, the vapor chamber according to the present invention is advantageous for size reduction, especially for thickness reduction. Accordingly, the vapor chamber can be suitably used in devices, such as electronic devices, of which the size reduction is demanded.

The method of manufacturing the vapor chamber of the present invention is not specifically limited insofar as the above-described configurations are obtained. For example, the vapor chamber can be obtained by overlaying the first sheet having the wick structure disposed thereon and the second sheet having the pillars disposed thereon, forming the portion that later becomes the specially shaped portion, injecting the working liquid, and joining the first sheet and the second sheet together.

The wide sealing portion is formed when the first sheet and the second sheet are joined together.

When the wide sealing portion is formed, the specially shaped portion is positioned in the wide sealing portion.

The method of joining the first sheet and the second sheet together is not specifically limited but may utilize, for example, laser welding, resistance welding, diffusion bonding, soldering, TIG arc welding (tungsten inert-gas arc welding), ultrasonic bonding, or plastic molding. Of these methods, laser welding, soldering, or diffusion bonding may be preferably used.

REFERENCE SIGNS LIST

1, 1', 2, 3, 4, 5, 6, 7, 8, 9 vapor chamber
10 housing
11 first sheet
11*a* principal surface of first sheet that opposes second sheet (inside surface of first sheet)
12 second sheet
12*a* principal surface of second sheet that opposes first sheet (inside surface of second sheet)
13 cavity
20 working liquid
30 wick structure
31 protruding portion
32 mesh
40 pillar
50 sealing portion
51 normal sealing portion
52, 52*a*, 52*b* wide sealing portion
60, 60*a*, 60*b*, 63, 64, 65 specially shaped portion
61 housing-side region of specially shaped portion
62 non-housing-side region of specially shaped portion
70 heat generating member

The invention claimed is:

1. A vapor chamber comprising:

a housing having a first sheet and a second sheet that oppose each other and of which respective peripheral regions are joined to each other to form a sealing portion, the sealing portion including a first portion having a first width and a second portion having a second width, the first width being greater than the second width, the housing having a specially shaped portion straddling the first portion, the specially shaped portion having a first inclination angle of the first sheet and/or the second sheet that rises from the first portion in a first housing-side region of the specially shaped portion that is greater than a second inclination angle of the first sheet and/or the second sheet in a second housing-side region outside of the specially shaped portion;

a working fluid enclosed within the housing; and a wick structure on an inside surface of the first sheet or the second sheet.

2. The vapor chamber according to claim 1, wherein the housing has a polygon shape, and the first portion extends along one side of the polygon.

3. The vapor chamber according to claim 1, wherein the housing has a polygon shape, and the first portion extends along part of one side of the polygon.

4. The vapor chamber according to claim 1, wherein the sealing portion is a welded portion, a soldered portion, or a diffusion bonded portion.

5. The vapor chamber according to claim 1, wherein the specially shaped portion orthogonally intersects the first portion.

6. The vapor chamber according to claim 1, wherein the specially shaped portion obliquely intersects the first portion.

7. The vapor chamber according to claim 1, wherein the second inclination angle is 0°.

8. The vapor chamber according to claim 1, wherein the first width is 0.5 mm to 3 mm.

9. The vapor chamber according to claim 8, wherein the second width is 0.1 mm to 1 mm.

10. The vapor chamber according to claim 1, wherein the second width is 0.1 mm to 1 mm.

11. The vapor chamber according to claim 1, wherein a ratio of the first width to the second width is 1.5 to 5.

12. The vapor chamber according to claim 1, wherein a width of the specially shaped portion is 0.5 mm to 3 mm.

13. The vapor chamber according to claim 1, wherein the housing includes two specially shaped portions in the first portion.

14. The vapor chamber according to claim 1, wherein the sealing portion includes a third portion having a third width, the third width being greater than the second width, the housing having a second specially shaped portion in the third portion.

* * * * *